United States Patent [19]

Bowden

[11] Patent Number: 4,651,762

[45] Date of Patent: Mar. 24, 1987

[54] AGITATION PARTS DEGREASER

[75] Inventor: Donald R. Bowden, Huntsville, Ala.

[73] Assignee: Bowden Industries, Inc., Huntsville, Ala.

[21] Appl. No.: 750,200

[22] Filed: Jul. 1, 1985

[51] Int. Cl.[4] ..... B08B 3/08

[52] U.S. Cl. ..... 134/111; 134/109; 134/105; 134/10; 134/40; 210/305; 210/523

[58] Field of Search ..... 134/10, 60, 105, 109, 134/111, 110, 40; 210/305, 416.5, 538, 521, 523; 260/412.5

[56] References Cited

U.S. PATENT DOCUMENTS

| | | | |
|---|---|---|---|
| 2,468,864 | 5/1949 | Campbell | 210/523 X |
| 2,711,978 | 6/1955 | Groom | 134/109 X |
| 3,086,538 | 4/1963 | Voltz | 134/111 |
| 3,156,248 | 11/1964 | Rand . | |
| 3,592,205 | 7/1971 | Sheppard | 134/109 X |
| 3,734,776 | 5/1973 | Keogh . | |
| 3,810,786 | 5/1974 | Lingren . | |
| 3,812,869 | 5/1974 | Szczepanski | 134/111 |
| 3,930,879 | 1/1976 | Erickson . | |
| 4,021,344 | 5/1977 | Webb | 210/776 X |
| 4,078,942 | 3/1978 | Luisi et al. | 134/10 |
| 4,082,867 | 4/1978 | Henley et al. . | |
| 4,136,217 | 1/1979 | Henley et al. . | |
| 4,138,273 | 2/1979 | Lukac et al. | 134/10 |
| 4,162,199 | 7/1979 | English . | |
| 4,268,396 | 5/1981 | Lowe | 210/776 X |

FOREIGN PATENT DOCUMENTS

| | | | |
|---|---|---|---|
| 54-51591 | 4/1979 | Japan | 134/10 |

*Primary Examiner*—Harvey C. Hornsby
*Assistant Examiner*—Frankie L. Stinson
*Attorney, Agent, or Firm*—Dowell & Dowell

[57] ABSTRACT

An agitation type degreaser for cleaning oil from parts by contacting them with a cleaning liquid, and at the same time removing oil from the cleaning liquid, including a container filled with cleaning liquid, a partition dividing the container into a first turbulent-liquid chamber receiving the parts to be cleaned and a second calm-liquid chamber used for oil separation and removal, suction and discharge ducts communicating with the first chamber and a liquid pump operative to draw liquid from the suction ducts and discharge it through the discharge ducts into the first chamber at high velocity to maintain turbulence, and the second chamber including oil removal and recovery apparatus including one or more bleed holes operative for delivering a proportion of the discharged cleaning liquid from the ducts into the calm liquid of the second chamber, and including one or more openings below the surface of the liquid through which a flow of calm liquid will pass back into the first chamber. The partition or a portion thereof is moveable while the pump is turned off so that it can be swept from the side of the container most remote from the second chamber until it reaches its normal position to move before it the entire oil skim into the second chamber to be removed by the oil skimmer during subsequent operation of the apparatus.

8 Claims, 7 Drawing Figures

AGITATION PARTS DEGREASER

BACKGROUND AND PRIOR ART

This invention relates to apparatus used for cleaning manufactured parts, and specifically for removing oil from the surfaces thereof by immersing the parts in a container of cleaning liquid maintained in a highly turbulent state. Since this is an on-going cleaning process, the oil must then be removed from the cleaning liquid. In the past, this has been done by drawing the cleaning liquid from the container and processing it, and then returning the liquid to the container for use in future parts cleaning operations. The usual way of processing the contaminated cleaning liquid is to pass it through a filter cartridge which removes the bulk of the oil, but which must be frequently replaced by new cartridges, which is expensive and time consuming.

In view of the fact that the parts being cleaned must be lowered into the agitated liquid and later retrieved by raising them through the surface thereof, the liquid must be sufficiently agitated that the oil can not form a skim on the liquid surface. Otherwise, the cleaned parts would be again contaminated as they are raised through the surface during removal from the container. In prior art apparatus of this type, besides filtering of the liquid during its use, which was not fully effective to keep down the build-up of oil in the container, the apparatus had to be periodically shut down to allow the oil to float to the surface of the liquid and form a skim thereon, which was removed by a skimmer wheel or belt from the surface while the liquid was still quiescent. U.S. Pat. Nos. 4,082,867 and 4,136,217 to Henley show skimmer belts operating in oil recovery tanks which are located separately. Such periodic shutting down of the apparatus is inefficient, and often not done sufficiently frequently.

The prior art shows other ways of removing oil from cleaning liquids. For instance, in U.S. Pat. No. 3,734,776 to Keough the oil is removed by centrifuging; in U.S. Pat. No. 4,162,199 to English the oil is removed by distillation; in U.S. Pat. No. 3,156,248 to Rand it is removed by vaporization; and in U.S. Pat. No. 3,930,879 to Erickson it is removed by separating a proportion of the cleaning liquid from the container and sending it to a gravity separator where the oil separates out and is left behind when the wash water is returned to the container. In U.S. Pat. No. 3,810,786 to Lindgren the oil is likewise separated out in an auxiliary tank with a vertical partition dividing the tank below the floating level of the oil.

In this disclosure the cleaning liquid is an alkaline solution in water, a particular example of which comprises a commercially available product of J. Hall Marketing Company, type 108B which is added to water. Other cleaning products are of course available for substitution instead of the liquid solution just mentioned. The oil being lighter than the solution, it floats to the surface and forms a skim if the solution is relatively quiescent. The high turbulance in the cleaning container is of course very helpful in cleaning the parts placed therein.

THE INVENTION

This invention comprises an agitation degreaser for cleaning oil from parts by contacting them with a cleaning liquid, and at the same time removing oil from the cleaning liquid with which the oil is immiscible. The apparatus occupies a single container filled to a high level with cleaning liquid which is heavier than the oil being removed. The container is traversed by an upright partition having a top extending above said liquid level and dividing the container into a first turbulent-liquid chamber receiving the parts to be cleaned and a second calm-liquid chamber used for oil separation and removal. The container includes one or more suction ducts and one or more discharge ducts all communicating with the first chamber, and includes a liquid pump connected with said ducts and operative to draw liquid from the suction ducts and discharge it through the discharge ducts back into the first chamber at high velocity, whereby to maintain the liquid in the first chamber in a high state of turbulence sufficient to prevent accumulation of an oil skim at the surface of the liquid so that cleaned parts can be removed by passing them upwardly through the surface without re-contamination.

The second chamber is used for oil removal and recovery and is entered by one or more bleed holes operative for delivering a proportion of the discharged cleaning liquid diverted from the ducts into the calm liquid of the second chamber. The latter chamber includes one or more openings located well below the surface of the liquid where the liquid is virtually free of oil droplets, whereby a portion of the calm liquid passes through said openings and back into the first chamber. Since the liquid in the second chamber is virtually quiescent, an oil skim forms on its surface and is prevented by the partition from spreading onto the surface of the liquid in the first chamber. In order to remove this skim and recover the oil, an oil skimmer is operatively placed at the liquid surface in the second chamber for skimming oil therefrom and delivering it outside the container.

In addition, the partition can either be made so that it is moveable within the container or it can be horizontally divided so that its top portion can be separated from a fixed main portion of the partition at a location below the liquid surface. The moveable partition or its top portion can thus be used as a scraper to skim the entire container's surface at a time when the pump has been turned off, i.e. when the entire liquid content of the container has been quiescent for a long enough time for the oil to separate out and float up and form a skim over the entire liquid surface. The top portion of the partition is then partially immersed in the liquid to a level below the skim, and is moved from the side of the container most remote from the second chamber until it reaches the normal location of the partition where it is again fixed in place. In this way, the entire oil skim is moved into the second chamber, whereby upon start-up of the apparatus the oil skimmer will begin removing the entire skim while the first chamber is again being used for cleaning of parts. This scraper is an optional feature useful at start-up of the degreaser, but not necessary, since the continuous oil removal feature in the second chamber does a continuous and adequate job of removal.

OBJECTS AND ADVANTAGES OF THE INVENTION

It is a principal object of this invention to provide a parts cleaning apparatus which comprises a single container for cleaning liquid which is divided into two chambers, i.e. a first chamber wherein the liquid is agitated to clean parts and a second chamber in which the liquid is relatively calm so that oil floats to the surface and can be readily removed by skimming, cleaned liquid from the second chamber being returned to the first chamber, for example through the pumped liquid main stream or through or around the dividing partition.

Another major object of this invention is to provide a parts cleaner which does not include oil filtering elements that clog and therefore require cleaning or replacement.

It is a further object of the invention to provide a parts cleaner comprising only a single container in which the oil skimming and removal can be continuously accomplished in a quiescent chamber at the same time that parts are being cleaned in a turbulent chamber, whereby the cleaner can be run continuously without requiring periodic shut-downs for oil removal.

An more specific object of this invention is to provide a parts cleaner in which the container is divided into said two chambers by a vertical partition which may either be divided into a separable top portion and a lower main portion which is fixed in the container, or by a single moveable partition whose top extends above the liquid level. In either case, when the agitation of the liquid has been ceased for a long enough time for oil in both chambers to rise to the top and form a skim, the partition, or its upper portion, can be moved from the side of the first chamber most remote from the second chamber back again to the normal position of the partition, thereby to move all the oil skim into the second chamber where it can be removed by the skimmer when the apparatus is again started up.

Another important object of this invention is to provide a cleaner in which the liquid in the turbulent chamber can be agitated sufficiently to prevent the build-up of an oil skim on the surface of that chamber, whereby parts can be lifted from the chamber and passed through the surface of its liquid without re-contamination of the cleaned parts with oil. The build up of and oil skim on the surface of the liquid in the trubulent chamber is also further discouraged by the fact that in the preferred embodiment of the invention the liquid being taken into the suction duct for delivery to the pump will be taken at and just below the surface of the liquid so that any oil floating at the surface of the liquid is withdrawn into the pump rather than being allowed to build up thereabove.

It is a still further object of this invention to provide a parts cleaner in which all oil removal can be accomplished by the use of a mechanical skimmer rotating in a different location of the same container in which the parts are cleaned.

Other objects and advantages of the invention will become apparent during the the following discussion of the drawings.

DESCRIPTION OF ILLUSTRATED EMBODIMENTS

Figure 1:
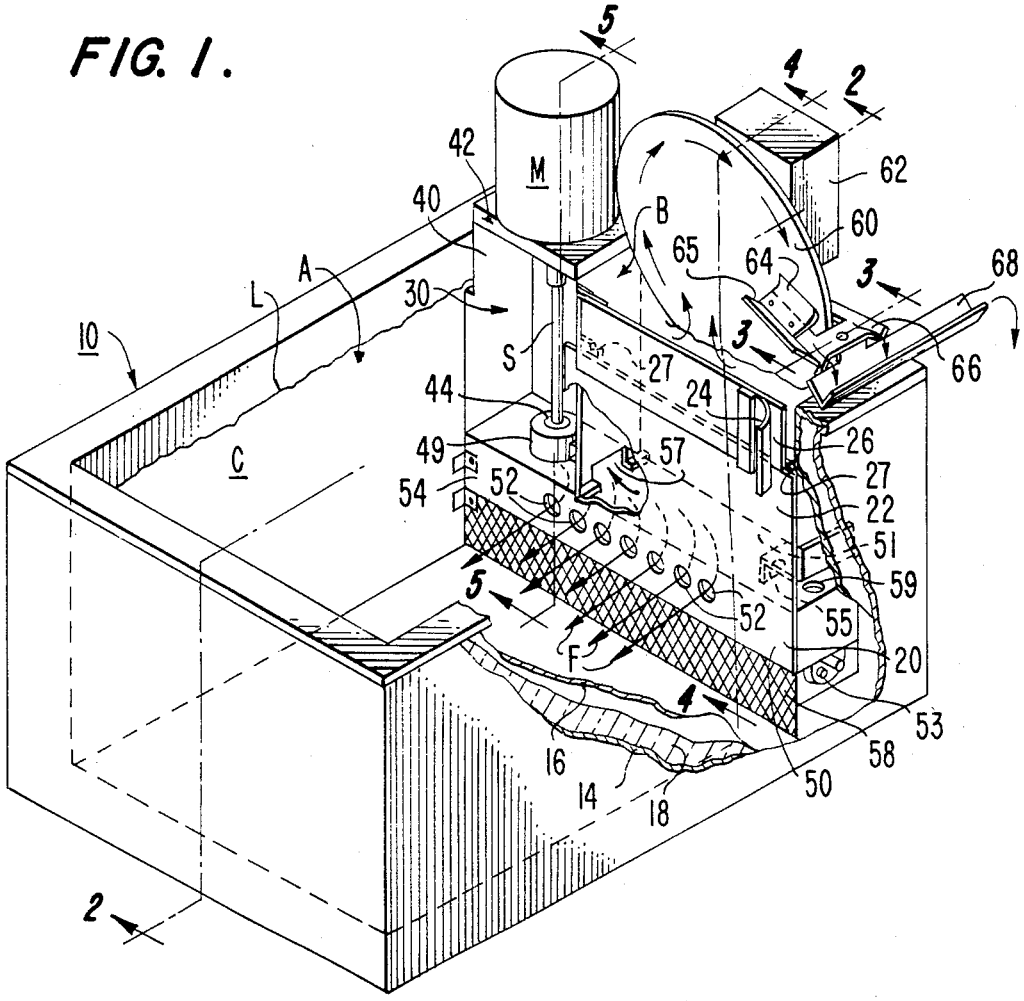
FIG. 1 is a perspective view, partially shown in section, of a preferred embodiment of the invention.
Figure 4:
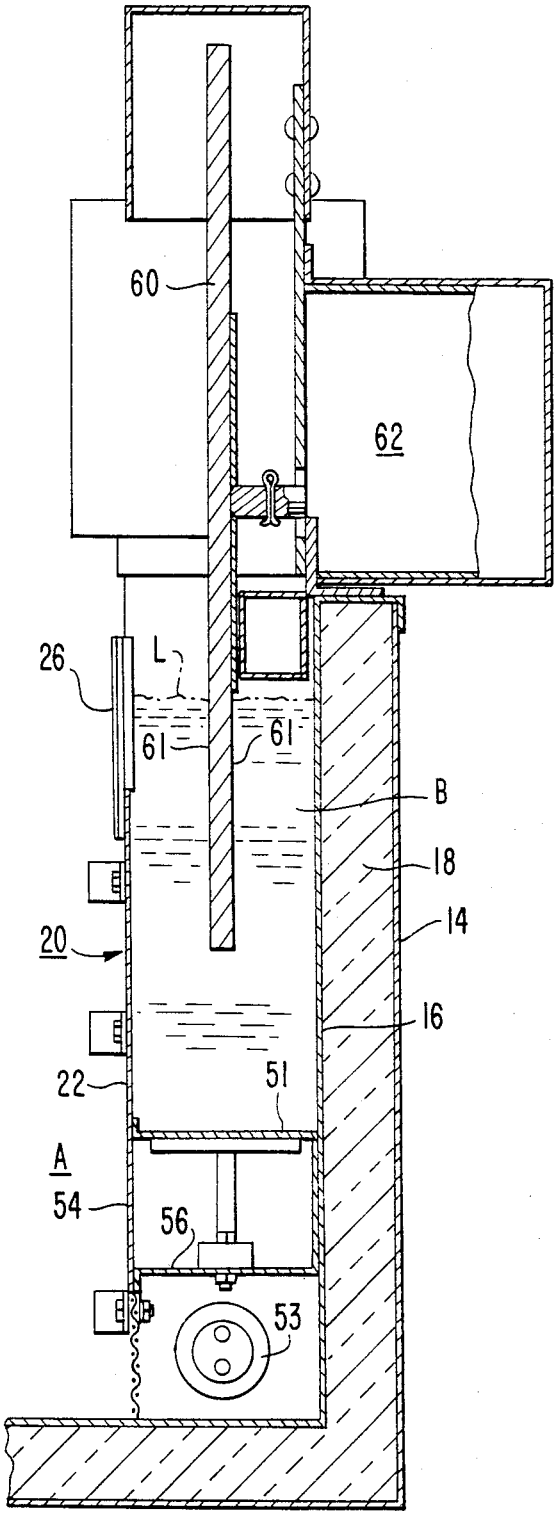
FIG. 4 is an enlarged partial cross-sectional view which is taken along lines 4—4 of FIG. 1.
Figure 7:
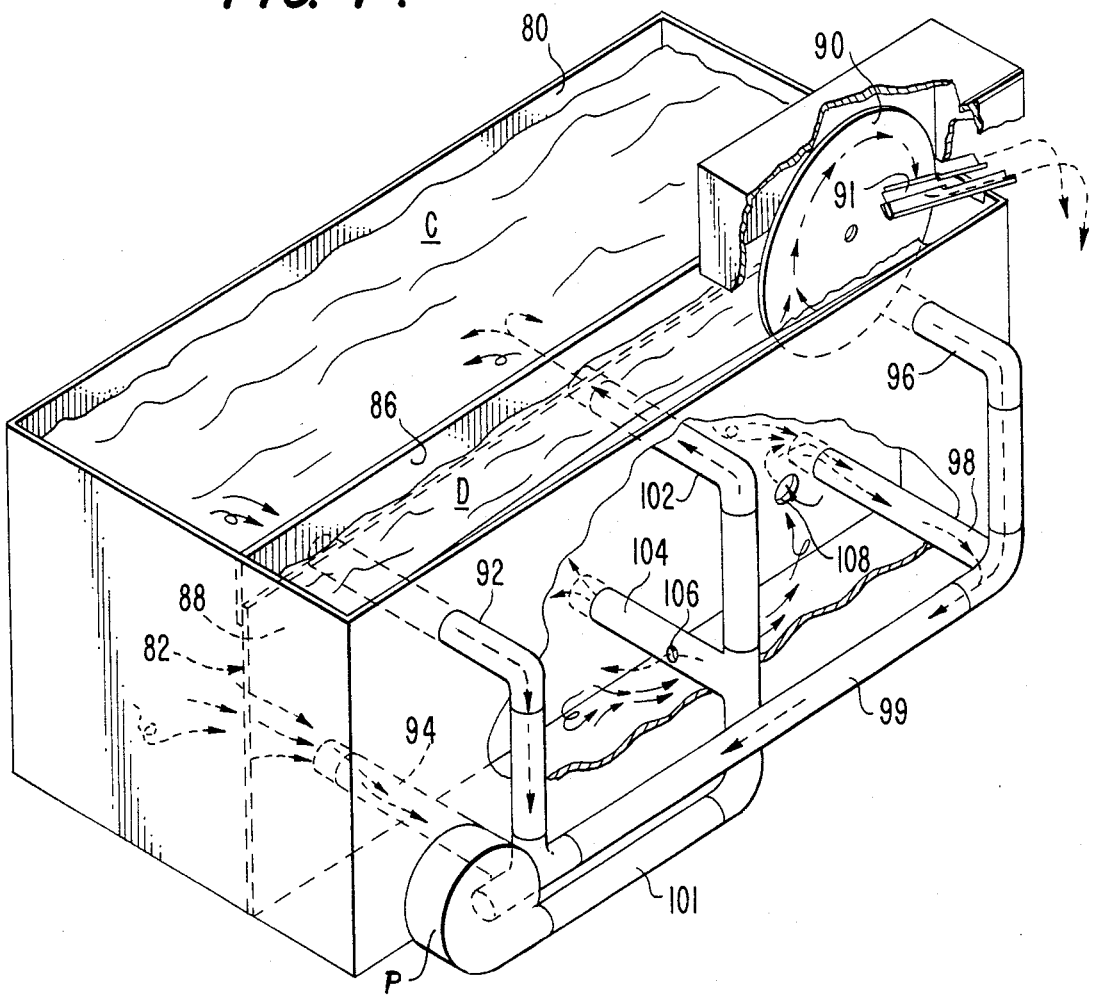
FIG. 7 is a perspective view, partially shown in section, of a modified embodiment of the invention.

Referring now to the drawings, and particularly to the perspective view of FIG. 1, this figure shows an agitation degreaser for cleaning oil from parts by contacting them with a cleaning liquid, comprising for example an aqueous alkaline solution. The degreaser also has means for removing oil from the cleaning liquid, on which it tends to float and form an oil skim on the liquid surface. The apparatus occupies a unitary container which is either a single wall container 80 as shown in the embodiment of FIG. 7, or which comprises a double walled container 10 as shown in FIG. 1 having an outer wall 14 and an inner wall 16 spaced therefrom. The space between the walls 14 and 16 is filled with a heat insulating material 18 for the purpose hereinafter stated as can be seen best in FIGS. 4 and 5. The container 10 is filled to a high level L with said cleaning liquid C. The container 10 is traversed by an upright partition 20 having a lower portion 22 which is fixed in place relative to the inner wall of the container, and having an upper portion 26 comprising the top of the partition which extends above said liquid level L, the partition dividing the container into a first turbulent-liquid chamber A receiving the parts to be cleaned and a second calm-liquid chamber B used for oil separation and removal. The upper portion 26 of the partition 20 includes a rubber wiper and seal 24, and includes small brackets 27 which serve as means to secure the upper partition portion 26 on the lower portion 22 when the two are united.

Figure 2:
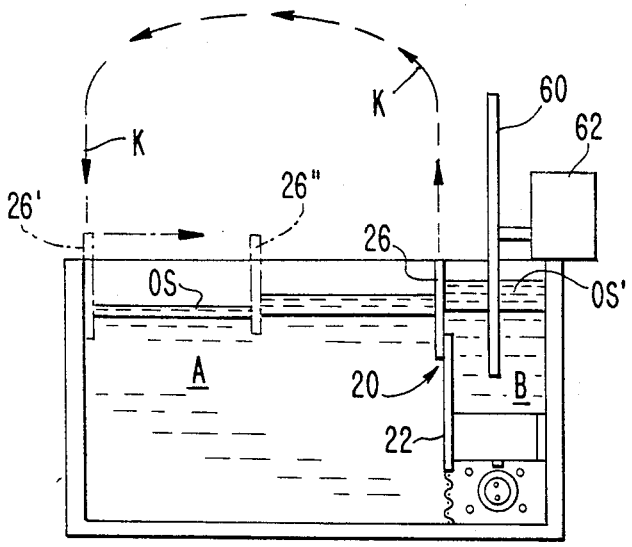
FIG. 2 is a cross-sectional view which is taken along lines 2—2 of FIG. 1.
Figure 3:
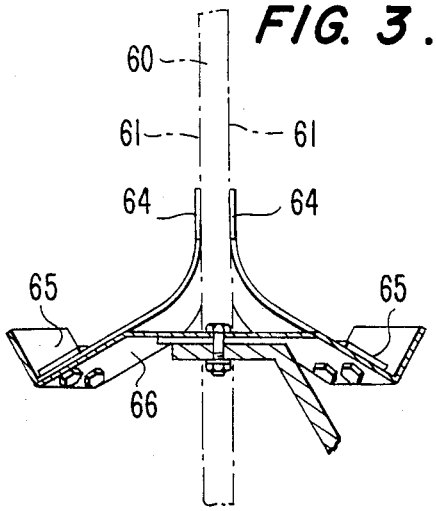
FIG. 3 is a an enlarged partial cross-sectional view which is taken along lines 3—3 of FIG. 1.

FIG. 2 shows how the upper portion 26 of the partition 20 can be separated from the fixed lower portion 22 thereof and used as an oil skim scraper when the pump is turned off. The upper portion 26 is moved by hand from the position 26 along the path of the arrows K to the dotted line position 26' located on the far side of the chamnber A remotely from the chamber B. The upper portion is then moved by hand to and through position 26'', driving before it the oil skim OS from the top of the liquid in the chamber A, until it again reaches the position 26 where it is re-united with the lower portion 22 of the partition 20. As a result, all the floating oil skim has been displaced into the chamber B as shown at OS', from which location it will then be removed by the skimmer wheel 60, as hereinafter described.

Figure 5:
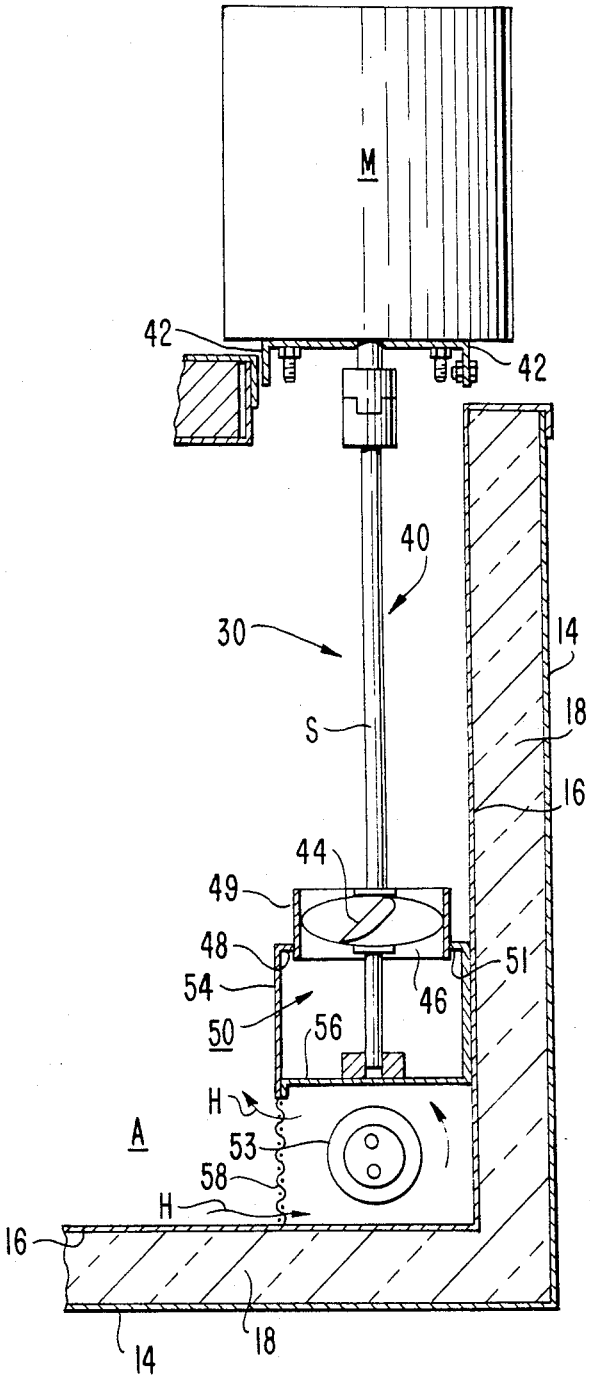
FIG. 5 is an enlarged partial cross-sectional view which is taken along lines 5—5 of FIG. 1.
Figure 6:
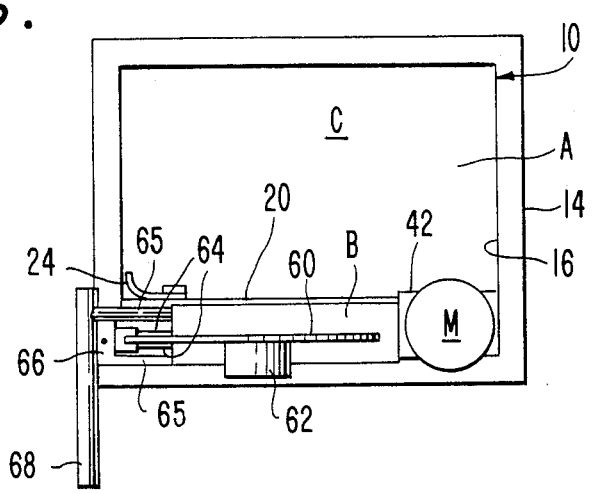
FIG. 6 is a plan view of the embodiment of FIG. 1, but shown on a smaller scale.

The container includes one or more suction ducts which communicate with a liquid pump which will be described hereinafter with reference to FIG. 5. The suction duct means in FIG. 1 comprises the whole open side of the pump column 40 in the vicinity of the reference character 30 which is left open to allow liquid from the chamber A to flow freely into the pump column 40. The container also includes discharge ducts 52 all of which communicate from the liquid pump back into the first chamber A. The pumping of the liquid from the first turbulent chamber A, and back into it at high velocity serves to maintain high turbulence in that chamber where the parts are being cleaned and degreased.

Two different types of pumping arrangements are shown in the respective different embodiments of FIGS. 1 through 5, and of FIG. 7. The arrangement shown in FIGS. 1 and 5 comprises a vertical column 40 which takes up part of one corner of the calm-liquid chamber B. The column has a motor support 42 carrying a motor M whose shaft S carries a pump impeller 44 located in a hole 46 in a horizontal plate 48 extending across the column 40, see FIG. 5. The plate 48 carries a shroud ring 49 surrounding the impeller 44 and increasing the flow of liquid downwardly through the hole 46 in the plate into the lower end of the column 40. The lower end of the vertical column 40 communicates into a horizontal channel 50 which extends across and occupies part of the calm-liquid chamber B near to but just above the bottom of the container 10 and in fact forms the bottom of the calm-liquid chamber B, which is therefore shallower than the turbulent chamber A as can be seen best in FIG. 5. This horizontal pump channel 50 has a number of discharge ducts comprising holes 52 extending through its vertical wall 54 back into the turbulent chamber A, whereby cleaning liquid pumped by the impeller from the inlet suction duct 30, down through the vertical column 40 and into the horizontal channel 50, will be discharged at high velocity into the the turbulent chamber A as shown by the liquid circulation arrows F in FIG. 1.

As can also be seen clearly in FIG. 5, below the lower wall 56 of the horizontal channel 50 there is mounted an electric heater unit 53 which communicates with the turbulent chamber A through a screen 58 so that cleaning liquid in the chamber A will circulate around the heater 53 by convection as shown by the arrows H, keeping the liquid heated to a temperature at which its cleaning action on the parts in the chamber A will be optimized. This temperature can be thermostatically controlled if desired. Improved retention of the heat in the liquid in the container is the reason for insertion of the insulation 18 between the container walls 14 and 16. By the above pumping structure, the turbulence in the chamber A is maintained to a degree sufficient to prevent accumulation of an oil skim at the surface of the liquid so that cleaned parts can be removed by passing through the surface without risking re-contamination.

The second chamber B, referred to also as the calm-liquid chamber, is located adjacent to the vertical pumping column 40 and above the top wall 51 of the horizontal channel 50, and is separated from the turbulent chamber A by the partition 20 whose lower portion extends upwardly beyond the top wall 51 of the horizontal column 50 and may actually be integral with the vertical wall 54 of the horizontal column 50. This calm-liquid chamber B is used for oil separation and removal and recovery. Liquid being pumped through the vertical pumping column 40 and horizontal channel 50 is mostly delivered back into the turbulent chamber through the discharge duct holes 52. However, a certain proportion of the pumped liquid is conducted by one or more bleed holes 59 into the calm-liquid chamber, so that oil laden liquid passing through the bleed hole, or holes 59, will enter the chamber B where the oil will be separated from the cleaning liquid by floatation and will be removed from that chamber by an oil skimmer wheel to be described hereinafter. The bleed hole 59 has a baffle 55 located above it against which liquid re-entering chamber B impinges to interrupt its upward velocity and prevent undue agitation of the liquid in the chamber B. The second chamber B includes one or more openings 57 through the vertical wall 41 of the pump column 40, preferably deep down below the surface of the liquid in the chamber B where the liquid is virtually free of oil droplets. A portion of the calm liquid from the chamber B passes through said openings 57 and returns to the pumped main liquid stream from which most of it will go back into the first chamber A as cleaned liquid.

Since the liquid in the second chamber is virtually quiescent, an oil skim forms on its surface and this skim is prevented from returning to the turbulent-liquid chamber A by the partition 20. An oil skimmer shown best in FIGS. 1, 3 and 4 serves to remove the oil from chamber B , the skimmer comprising a skim wheel 60 supported on the shaft of a low RPM motor 62. The wheel 60 has its lower periphery turning in the cleaning liquid, the opposed surfaces 61 of the wheel 60 being of such texture as to encourage the oil to adhere to them so that the oil rises with the two wheel surfaces 61 and is brought into contact with two flexible scrapers 64 supported on a bifurcated bracket 66 which is channelled as shown at 65 in FIG. 3 to collect the scraped oil in a trough 68, FIG. 1, from which it is delivered to a suitable container (not shown) outside the degreaser assembly.

FIG. 7 shows a second simpler embodiment of the invention wherein the turbulence pump and the ducts are external to the container 80 which is single walled. In this embodiment, the container 80 is divided into a turbulent liquid chamber C and a calm-liquid chamber D by a vertical partition 82 which is divided horizontally into an upper portion 86 and a lower portion 88 which is fixed appropriately to the container 80. The upper portion 86 is separable from the fixed lower portion 88 so that it can be used as a scraper to skim the surface of the turbulent-liquid chamber C as illustrated in FIG. 2 when the pump is turned off and move any oil skim accumulated on the liquid surface in chamber C into chamber D, whereby the skimmer wheel 90 can remove the skim as the assembly operates.

In FIG. 7, the suction ducts comprise pipes 92, 94, 96 and 98 which pass through the chamber D without communicating with it and open into the turbulent-liquid chamber C, where they suck liquid therefrom and deliver it into the inlet to a pump 100 through duct 99. The discharge from the pump 100 is delivered through duct 101 to the discharge ducts 102 and 104 which extend through the calm-liquid chamber D and discharge at high velocity into the turbulent-liquid chamber C. A part of the returning liquid in the discharge duct 104 is bled into the calm-liquid chamber D through one or more bleed holes 106 so that some of the oil-laden cleaning liquid is entered into the calm-liquid chamber D to have its oil separated from it by floatation and skimming by the skimmer wheel 90, which operates in the same manner as the skimmer wheel 60 described above with reference to FIG. 1, i.e. the wheel being scraped as it rotates against scrapers 91. Since oil-laden cleaning liquid is being entered into the calm-liquid chamber D through the bleed hole 106 for oil removal, and since the cleaning liquid located well below the surface in the calm-liquid chamber D is relatively clean, one or more openings 108 through the partition 82 are provided to allow cleaned liquid to re-enter the turbulent liquid chamber C. Thus the operation of the simpler embodiment of FIG. 7 is essentially like the operation of the preferred embodiment of FIG. 1.

The apparatus for creating turbulance and for skimming the cleaning liquid as shown in FIG. 1 comprises a self-contined unit which need not be used in a special container 10 as shown in FIG. 1. Instead, it can be used in conjuction with other containers and can be easily adapted to fit various different shapes of containers.

This invention is not to be limited to the illustrative embodiments described above for obviously changes may be made within the scope of the following claims.

I claim:

1. An agitation degreaser for cleaning oil from parts by contacting them with a cleaning liquid, and at the same time removing oil from the cleaning liquid, comprising:

(a) a container filled to a high level with cleaning liquid which is heavier than the oil being removed;

(b) an upright partition means in said container having a top extending above the surface of said liquid and dividing said container into a first turbulent-liquid chamber receiving the parts to be cleaned and a second calm-liquid chamber, said partition means being selectively vertically adjustable so as to openly communicate said first turbulent-liquid chamber with said second calm-liquid chamber so that oil floating on the surface of said first turbulent-liquid chamber may be selectively urged into said second calm-liquid chamber;

(c) suction duct means and discharge duct means communicating with said first chamber;

(d) liquid pump means connected with said suction and discharge duct means and operative to draw liquid from said suction duct means and discharge it through said discharge duct means into said first chamber at high velocity, whereby to maintain the liquid in the first chamber in a high state of turbulence sufficient to prevent accumulation of an oil skim at the surface of the liquid in said first chamber;

(e) oil removal means operative in said second chamber and including bleed means operative for diverting a proportion of the cleaning liquid passing through said suction duct means and said duct means and said discharge duct means into the calm liquid of said second chamber, and including opening means leaving said second chamber below the surface of the liquid for passing a portion of the calm liquid back into said first chamber; and (f) oil skimming means operative at the liquid surface in the second chamber for skimming oil therefrom and delivering it outside the container.

2. A degreaser as claimed in claim 1, wherein said upright partition comprises a lower partition portion below the surface of the liquid and fixed in the container, and an upper partition portion extending above the surface of the liquid and meeting the lower portion below the surface of the liquid; and means for removably securing said upper portion to the fixed lower portion, whereby said upper portion can be separated from said lower portion and used as a scraper to move across said first chamber to push surface oil into said second chamber.

3. A degreaser as claimed in claim 2, wherein said oil skimming means in said second chamber comprises rotating means partially submerged in the liquid and having surfaces to which oil adheres when the rotating means surfaces rise above the liquid surface through an oil skim thereon, and scraper means contacting said rotating means surfaces and collecting and removing adhered oil therefrom.

4. A degreaser as claimed in claim 1, wherein said pump means and oil removal means comprise a vertical column adjacent to said first turbulent chamber and communicating therewith through said suction duct means; a horizontal channel adjacent to said first turbulent chamber and communicating therewith through said discharge duct means; and said liquid pump means operative to pump liquid from said vertical column into said horizontal channel at high velocity, said suction duct means being open near the top of said vertical column whereby it intakes liquid and oil from the surface of said first turbulent chamber.

5. A degreaser as claimed in claim 4, wherein said bleed means comprise a hole communicating from said vertical channel into said second chamber.

6. A degreaser as claimed in claim 4, wherein said vertical column and horizontal channel are located in said second chamber and communicate with said first chamber.

7. A degreaser as claimed in claim 4, further including electric heater means mounted within said container and beneath said second chamber, said electric heater means being in fluid communication beneath said upright partition means with said first chamber and being operative to heat the liquid in said first chamber.

8. A degreaser as claimed in claim 1, wherein said pump means is located outside said container, said suction duct means extending from said pump means and into said first chamber, said discharge duct means extending from said pump means through said second chamber and into said first chamber, and said bleed means extending from said discharge duct means into said second chamber.

* * * * *